US005176531A

United States Patent [19]

Lin

[11] Patent Number: 5,176,531

[45] Date of Patent: Jan. 5, 1993

[54] PC BOARD CONNECTOR SEAT

[76] Inventor: Sheng-Kuang Lin, P.O. Box 82-144, Taipei, Taiwan

[21] Appl. No.: 799,082

[22] Filed: Nov. 27, 1991

[51] Int. Cl.[5] ..... H01R 13/00

[52] U.S. Cl. ..... 439/326

[58] Field of Search ..... 439/296, 326

[56] References Cited

U.S. PATENT DOCUMENTS 4,850,892 7/1989 Clayton et al. ..... 439/326

5,061,200 10/1991 Lee ..... 439/326

5,064,381 11/1991 Lin ..... 439/326

*Primary Examiner*—Joseph H. McGlynn

*Attorney, Agent, or Firm*—Alfred Lei

[57] ABSTRACT

This invention relates to a PC board connector seat and in particular to one which includes a body portion, two positioning plates on the body portion, two engaging members at both ends of the body portion, two lower limit protuberances on the outer end side of the body portion having a distance from the engaging members, whereby the PC board connector seat can be easily operated to mount or dismounted a PC board therefrom and will be possessed of a long service life.

1 Claim, 6 Drawing Sheets

PC BOARD CONNECTOR SEAT

BACKGROUND OF THE INVENTION

It is found that the prior art PC board connector seat as shown in FIG. 1 is provided with two engaging members 2, two positioning plates 3 perpendicular to the engaging members 2, and two slots 5 between the engaging members 2 for receiving two PC boards 4. However, such PC board connector seat has the following drawbacks:

1. The user will be often hurted by the engaging members 2 in operation thereby causing inconvenience in mounting and dismounting of the PC board.

2. As the engaging members 2 are made of a very thin sheet of plastic, they will be easily broken and will lose their resilience in a short time.

Therefore, it is an object of the present invention to provide a PC board connector seat which may obviate and mitigate the above-mentioned drawbacks.

SUMMARY OF THE INVENTION

This invention relates to an improved PC board connector seat.

It is the primary object of the present invention to provide a PC board connector seat of which the engaging members are of high resilience.

It is another object of the present invention to provide a PC board connector seat which is easily operated to receive a PC board.

It is still another object of the present invention to provide a PC board connector seat of which the engaging members are of high strength.

It is still another object of the present invention to provide a PC board connector seat which is durable in use.

It is a further object of the present invention to provide a PC board connector seat which is economic to produce.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
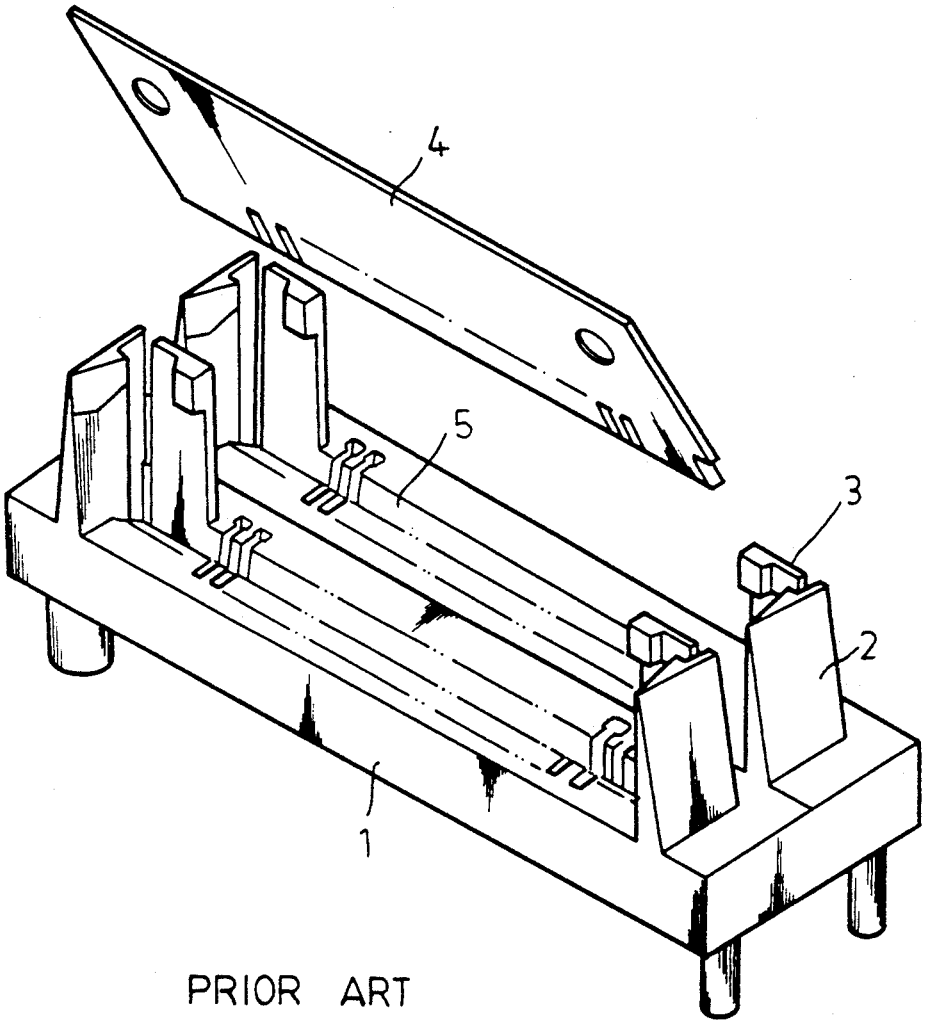
PRIOR ART FIG. 1
FIG. 1 is a perspective view of a prior art PC board connector seat.
Figure 2:
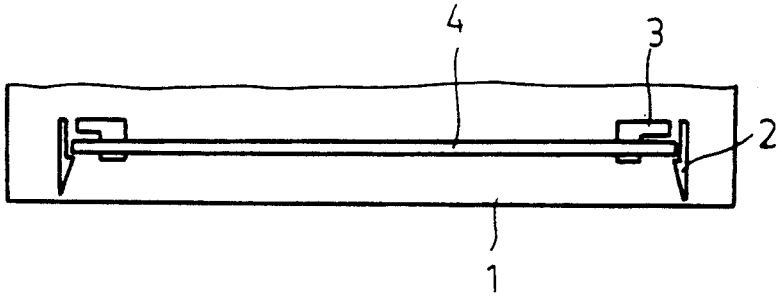
PRIOR ART FIG. 2
FIG. 2 is a top view of the prior art PC board connector seat.
Figure 3:
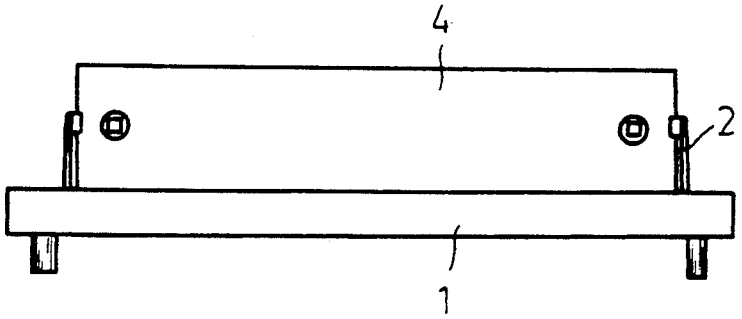
PRIOR ART FIG. 3
FIG. 3 is a front view of the prior art PC board connector seat.
Figure 4:
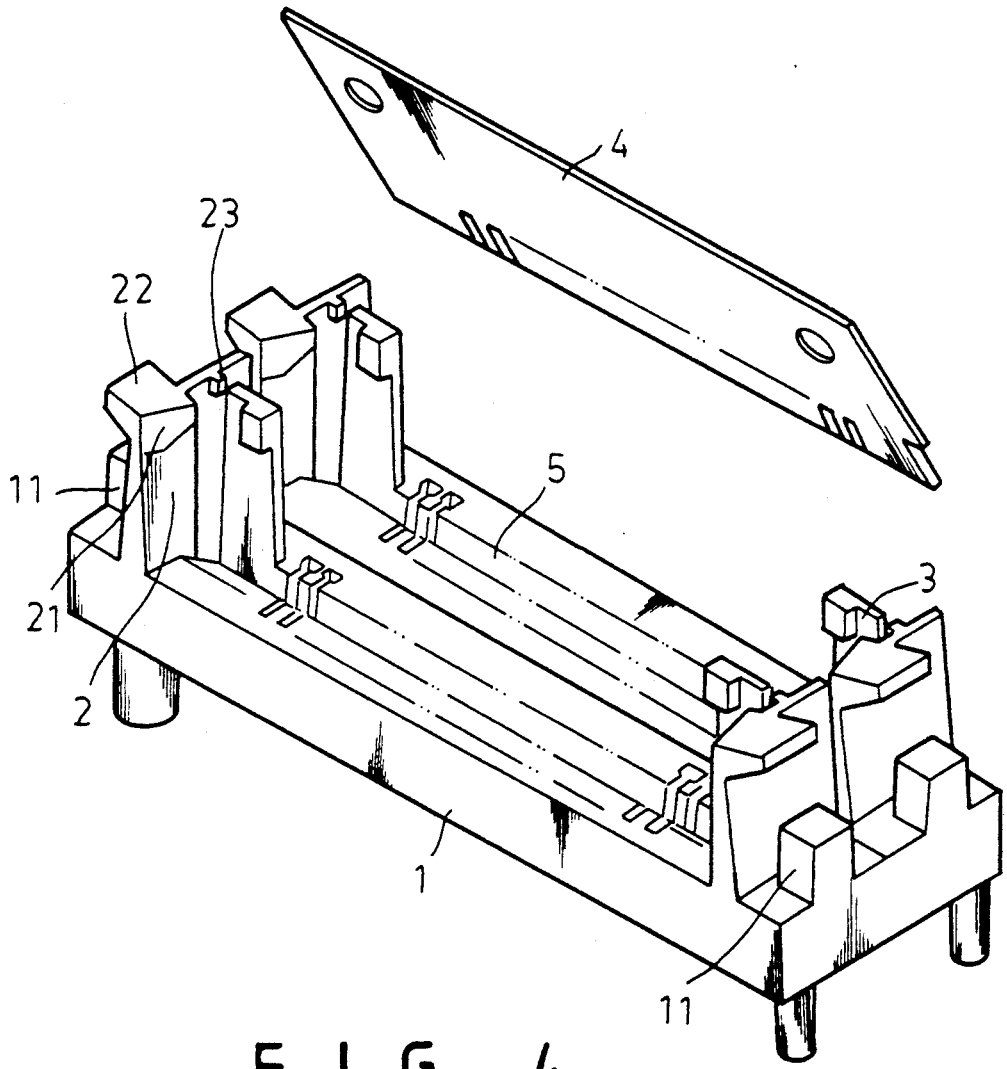
FIG. 4 is a perspective view of a PC board connector seat according to the present invention.
Figure 5:
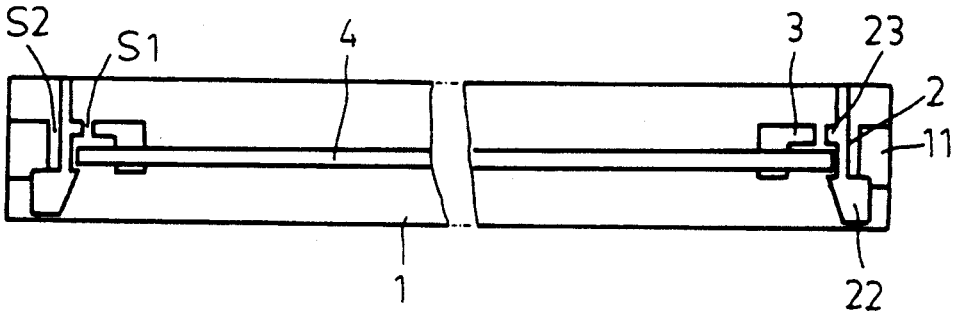
FIG. 5 is a top view showing one-half of the PC board connector seat.
Figure 6:
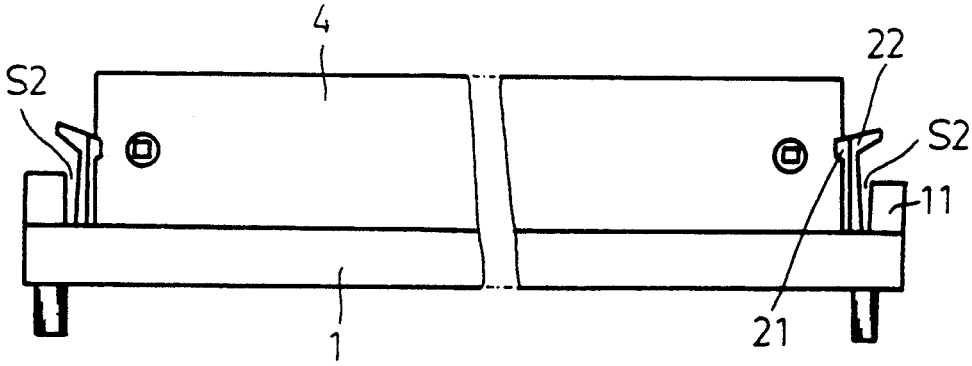
FIG. 6 is a front view of the PC board connector seat.

Referring now to the drawings and in particular to FIG. 4 thereof, the PC board connector seat according to the present invention comprises a body portion 1 which is provided with two engaging members 2 at both ends. Perpendicular to each engaging member 2 there is a positioning plate 3. Between the engaging members 2 at both ends of the PC board connector is formed a slot 5. The engaging members 2 are formed integrally with the body portion 1. Further, the engaging member 2 has a first oblique surface 21 extending upwardly to form a second oblique surface 22 which will keep the center of gravity of the engaging member 2 at the geometrical center of the engaging member 2 and will not increase the weight at the outer side of the engaging member 2. Hence, the engaging member 2 may keep its position even after a long period of time. Further, the engaging member 2 is provided with an upper limit protuberance 23 which is opposite to the positioning plate 3 and has a distance S1 from the positioning plate 3. On the outer end side of the body portion 1 there are two lower limit protuberances 11 which have a distance S2 from the engaging member 2. The distances S1 and S2 are designed to enable the engaging members 2 to move slightly outwards to receive a PC board.

In conclusion, the PC board connector seat according to the present invention has the following advantages:

1. The oblique surface 22 will facilitate the expansion of the engaging members 2 thereby making it easier for an user to replace the PC board 4.

2. The center of gravity of the oblique surface 22 is located at the center of the engaging members 2 so that the engaging members may keep their resilience even if they have been used for a long period of time.

3. The upper limit protuberance 23 may prevent the engaging members 2 from being broken while the lower limit protuberance 11 can prevent the engaging members 2 from going excessively outwards.

Figure 7:
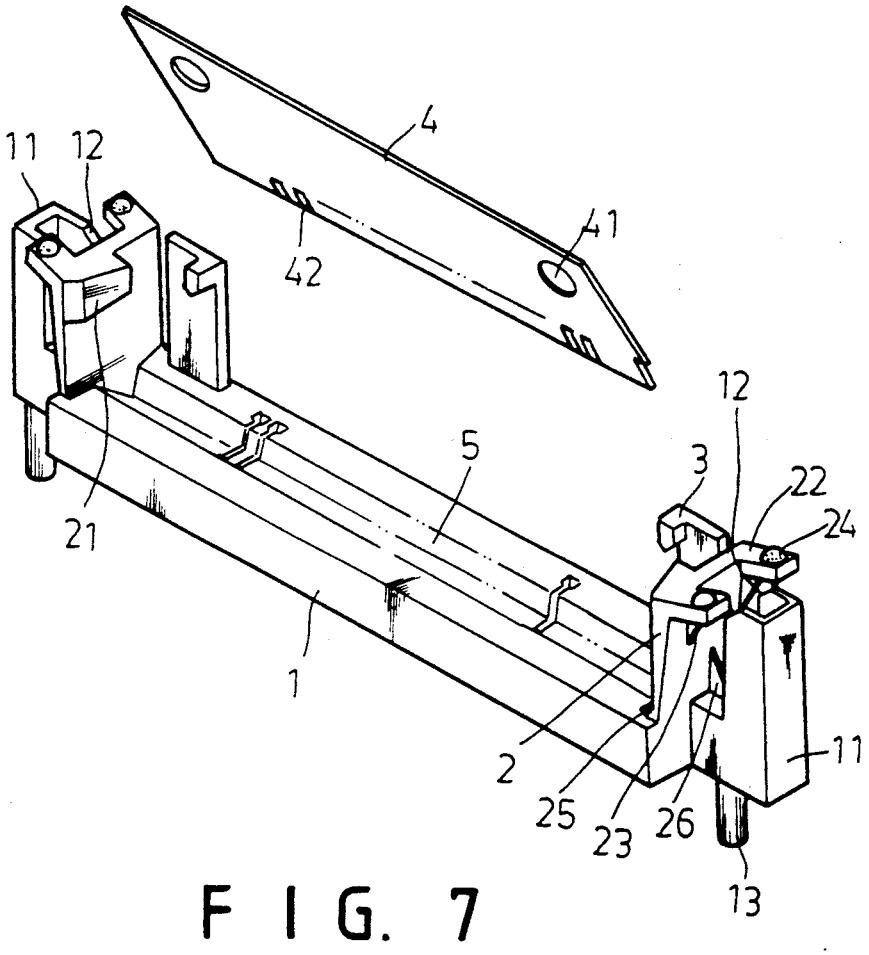
FIG. 7 is a perspective view showing another preferred embodiment of the present invention.
Figure 8:
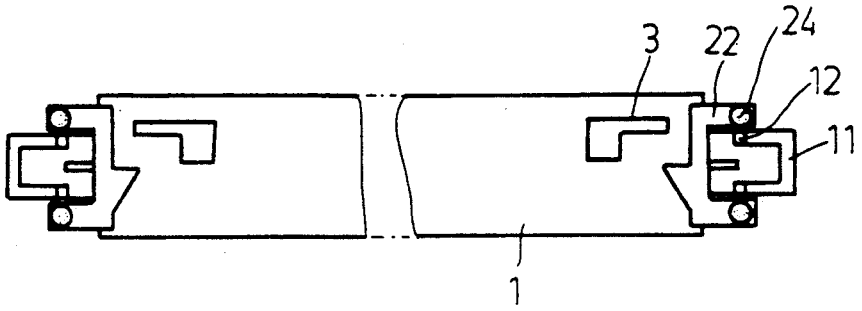
FIG. 8 is a top view of FIG. 7.
Figure 9:
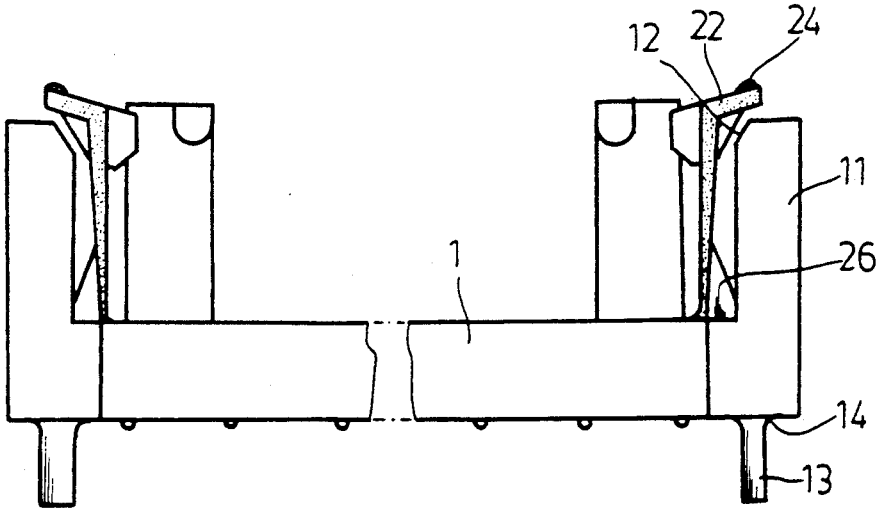
FIG. 9 is a front view of FIG. 7.

FIGS. 7, 8 and 9 show another preferred embodiment of the present invention. As illustrated, the embodiment is provided with an inverted U-shaped oblique surface 22 which makes an angle of 20 degrees with the horizontal. On the U-shaped oblique surface 22 there are two protuberances 24 for facilitating the engaging members 2 to be pushed outwards. The engaging member 2 further has a reinforcing rib 23 below the oblique surface 22. A fillet 25 is formed between the body portion 1 and the lower end of the engaging member 2. Between the body portion 1 and the engaging member 2 there is a reinforcing rib 26. On the outer end side of the body portion 1 there is a U-shaped member 11 with an inclined surface 12 at both arms.

The application of the present invention is too wide to be mentioned and cannot be all enumerated here in detail. It is understood that the present disclosure is made by way of example only and that numerous changes in the detail of construction and the combination of parts may be resorted to without departing from the spirit and scope of the invention as hereinafter claimed.

I claim:

1. A PC board connector seat comprising:

a body portion;

two engaging members at both ends of said body portion, said engaging members being provided with an oblique surface which will make the center of gravity of said engaging members locate at the geometrical center thereof, each one of said engaging members each further having an upper limit protuberance;

two positioning plates on said body portion and perpendicular to said engaging members, each one of said two positioning plates being located opposite to the correponding upper limit protuberance and spaced apart therefrom; and two lower limit protuberances on an outer end side of said body portion and spaced apart from said engaging members;

said two distances being designed to enable said engaging members to move slightly outwards to receive a PC board;

whereby the PC board connector seat can be easily operated to mount or dismount two PC boards therefrom and will be possessed of a long service life.

* * * * *